United States Patent [19]

Saad

[11] 3,939,320

[45] Feb. 17, 1976

[54] BEAM STIRRER

[75] Inventor: Theodore S. Saad, Westwood, Mass.

[73] Assignee: Micro-Tronics, Inc., Wisconsin Rapids, Wis.

[22] Filed: Apr. 12, 1974

[21] Appl. No.: 460,367

[52] U.S. Cl. ..... 219/10.55 F

[51] Int. Cl.[2] ..... H05B 9/06

[58] Field of Search ..... 219/10.55 F, 10.55 R; 333/95 R, 98 R, 98 M, 98 S

[56] References Cited

UNITED STATES PATENTS

| | | | |
|---|---|---|---|
| 3,431,381 | 3/1969 | Anderson | 219/10.55 F |
| 3,526,737 | 9/1970 | Black | 219/10.55 F |
| 3,789,179 | 1/1974 | Haagensen | 219/10.55 F |

*Primary Examiner*—Bruce A. Reynolds
*Attorney, Agent, or Firm*—Wolf, Greenfield & Sacks

[57] ABSTRACT

A microwave oven having means defining an oven cavity, a magnetron microwave power source, a waveguide for coupling energy from the magnetron to the oven cavity and preferably a mode matching transformer for establishing primarily only the dominant mode in the oven cavity. A beam stirrer is disposed adjacent the waveguide feed into the cavity and is in the form of a resonant structure for coupling the energy to the cavity. The resonant structure is rotated in an eccentric manner to spread the energy beam to thereby provide a more uniform heating pattern. In one specific form the resonant structure is a cylinder of relatively short length and dimensioned to provide good matching with the magnetron source along with beam motion.

14 Claims, 4 Drawing Figures

BEAM STIRRER

BACKGROUND OF THE INVENTION

The present invention relates in general to microwave ovens and more particularly to a beam stirrer used in the microwave oven for providing a more uniform heating pattern.

In order to provide uniform and rapid heating of materials and foods, high frequency energy, generally in the microwave region, has been utilized. Materials or foods to be heated are generally placed in an enclosure which is sealed to prevent the escape of high frequency energy. The energy generated, usually from a magnetron, is inserted either directly into the enclosure or indirectly through the use of a waveguide or other suitable coupling device.

Mode stirrers are well known in the art and are shown, for example, in U.S. Pat. No. 3,106,629. Although these mode stirrers do provide somewhat of an improvement in the uniformity of the heating pattern, there are certain disadvantages associated with these prior art structures. For example, there is generally a matching problem between the cavity and the magnetron which is occasioned by the abrupt discontinuity that occurs each time the blades of the stirrer rotate across the mouth of the waveguide opening.

Accordingly, one object of the present invention is to provide an improved structure for location within a microwave oven for providing a uniform heating pattern.

Another object of the present invention is to provide a beam stirrer for use in a microwave oven and that is in the form of a resonant structure capable of providing good matching with the magnetron.

A further object of the present invention is to provide a beam stirrer in accordance with the preceding object and that is moveable in an eccentric manner to provide beam motion over an area of the oven.

SUMMARY OF THE INVENTION

To accomplish the foregoing and other objects of this invention there is provided a beam stirrer for use in a microwave oven having an oven cavity, a source of microwave energy and means coupling the energy from the source to the cavity. The means for coupling the energy is preferably a waveguide structure and the source of microwave energy may be a conventional magentron. The beam stirrer is disposed in the oven cavity adjacent to the end of the waveguide which couples to the cavity and is in a position to receive the coupled energy. The beam stirrer basically comprises an energy coupling structure which in one embodiment is a hollow cylinder, means eccentrically supporting the structure and means for rotating the structure in an eccentric manner to thereby deflect the beam in many directions with the energy being coupled relatively uniformly as the structure rotates. The structure is preferably a quqrter wavelength structure that theoretically couples all of the energy from the waveguide to the cavity. By rotating the structure about an off-center axis energy is thereby effectively spread over a predetermined cooking area of the oven to provide a relatively uniform heating pattern over that area.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
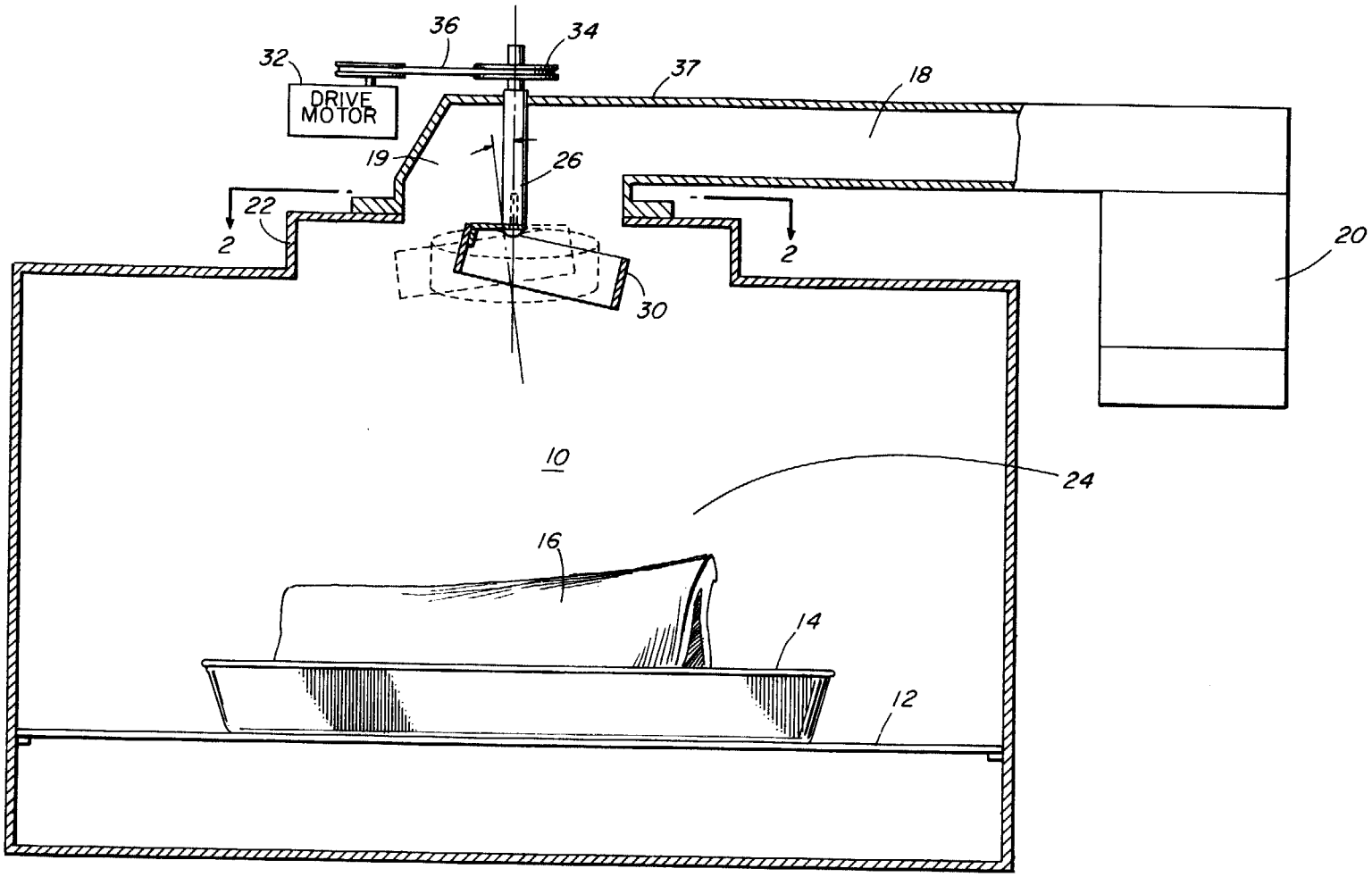
FIG. 1 is a cross-sectional view of a microwave oven using the beam stirrer of the present invention.

FIG. 1 shows a microwave oven 10 the structure of which may be similar to that shown in U.S. Pat. No. 3,764,770. The oven typically includes a rack 12 for holding a plate 14 which may support a foodstuff 16. Energy is coupled to the oven cavity by way of waveguide 18 from magnetron 20. In accordance with the teachings of my U.S. Pat. No. 3,764,770, there may be provided a quarter wavelength step 22 between the output end 19 of the waveguide and the oven cavity 24. This quarter wavelength step is for establishing primarily only the dominant mode within the oven cavity. Although this structure is shown in the illustrative embodiment it should be understood that the mode stirrer of the present invention may also be used with oven structures wherein the cavity has established therein multiple modes.

Figure 2:
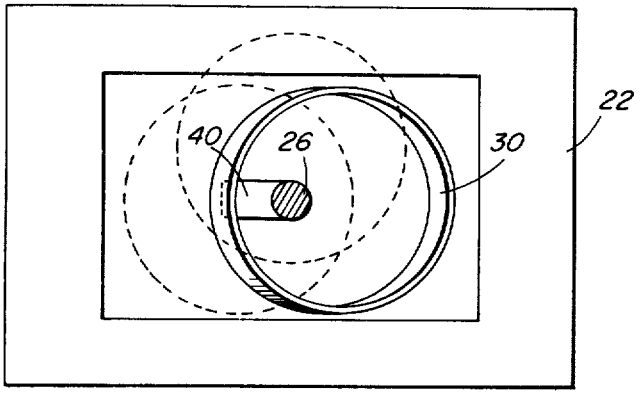
FIG. 2 is a cross-sectional view taken along line 2—2 of FIG. 1.
Figure 3:
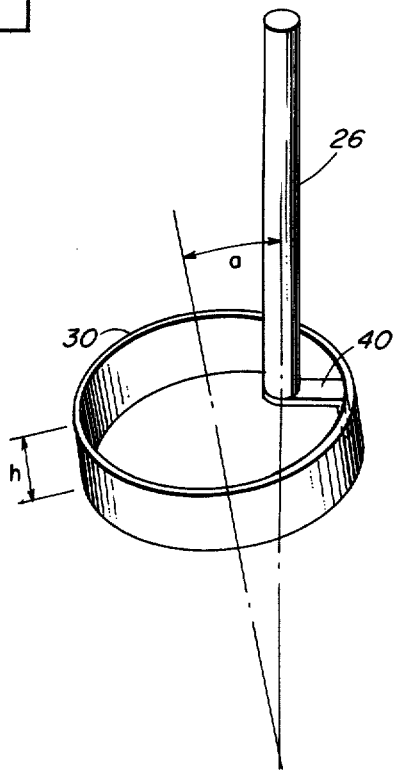
FIG. 3 is a perspective view of the beam stirrer shown in FIGS. 1 and 2.

Referring now to FIGS. 1–3, the beam stirrer comprises a support rod 26, a cylindrical coupling structure 30 and a drive motor 32. The support shaft 26 may be suitably supported at one or both ends and includes a pulley 34 attached to the top end. The pulley 34 is driven by way of a small belt 36 from the motor 32. The motor is suitably supported from a top wall 37 of the waveguide 18.

The coupling structure 30 is of cylindrical shape and is attached to the shaft 26 by means of an L-shaped tab 40 which is fixed at one end to the inner surface of structure 30 and at the other end to the bottom of shaft 26.

FIG. 2 clearly shows the eccentric arrangement of the present arrangement wherein the cylindrical coupling structure sweeps to cover an area larger than the area of the cylindrical structure itself.

FIG. 2 shows the structure 30 also in dotted in two other alternate positions. With this arrangement the energy from the waveguide is coupled to the cavity and the eccentric movement of the coupling structure 30 tends to spread the beam over the cooking area of the oven. It has also been found that it is desirable to provide a slight tilt to the coupling structure 30 relative to its support shaft 26. FIG. 3 shows this relatively small angle $a$ which may be on the order of 5°–10°. This angle $a$ can be provided simply by bending the tab 40 slightly.

The coupling structure 30 is basically a quarter wavelength structure but the dimensions are preferably slightly altered from this quarter wavelength structure (height $h$) to provide optimum matching between the magnetron and the oven cavity. Previously, the matching required the use of posts or other elements at the output end of the waveguide.

In the disclosed embodiment the height of the coupling structure may be 0.7 inches and the inside diameter may be two inches when using a waveguide of dimensions 1.50 by 3.75 inches.

It is known that the magnetron source should not be operated in the sink region of the Rieke diagram. See M.I.T. Radiation Laboratory Series, Radar System Engineering, Pages 336–340. If the height of the structure is too high the tube will be operating undesirably close to this sink area with too large a VSWR. Alternatively, if the height is made too small the match will not be proper. The height of 0.7 inches provided a proper match wherein the coupling structure represents a relatively low impedance to the magnetron source. By the proper selection of both the diameter and height of the resonant structure a relatively low VSWR can be provided. The coupling structure of this invention can also be used with an existing structure wherein the matching has already been provided. In that case, the structure may be more nearly a quarter wavelength structure.

Figure 4:
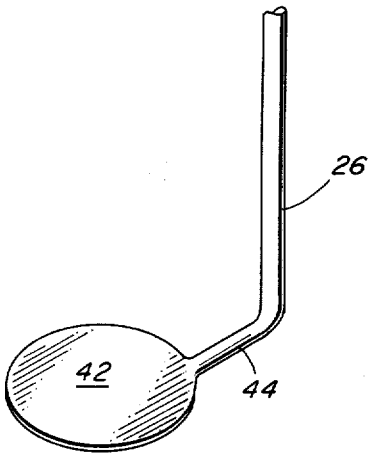
FIG. 4 shows an alternate embodiment for the beam stirrer.

FIG. 4 shows a perspective view of another embodiment of a stirrer. This embodiment employs a solid disc 42 connected to shaft 26 by means of a strip 44. This arrangement also provides a spreading of the beam coupled from the waveguide structure. In still another embodiment the disc 42 may be in the form of an open ring.

Having described a limited number of embodiments of the present invention it should now be apparent that there are numerous modifications that can be made in this ivention without departing from the scope thereof. For example, in the drawings a cylindrical coupling structure has been shown. However, this structure could also be square, eliptical, rectangular or could take on various other shapes. Also, the structure has been shown as being a continuous structure but could also be a segmented structure. Also, regarding the embodiment shown in FIG. 4 a dielectric material could be coupled to the end of the shaft and function as a coupling structure.

I claim:

1. In a microwave oven having means defining an oven cooking area, a source of microwave energy, and a waveguide means coupling the energy from the source to the cooking area, the improvement comprising;

an energy coupling structure disposed in the oven cooking area in a position adjacent one end of the waveguide means to receive the coupled energy and including a substantially continuous ring member defining a coupling opening extending in the direction from the waveguide means to the oven cooking area, means eccentrically supporting the structure from a wall adjacent the one end of the waveguide means and means for rotating the supporting means to in turn rotate the structure to thereby move the energy beam in many directions with the opening in the coupling structure being maintained extending in substantially the same direction as the structure is rotated so that the energy is coupled relatively uniformly as the structure rotates.

2. The beam stirrer of claim 1 wherein said energy coupling structure has at least one wall extending generally in the direction of the beam.

3. The beam stirrer of claim 1 wherein said energy coupling structure includes a cylindrical body of approximately quarter wavelength height.

4. The beam stirrer of claim 3 wherein said means for eccentrically supporting includes a shaft and tab means for securing the shaft close to one section of the body.

5. The beam stirrer of claim 4 wherein said means for rotating includes motor means coupled to said shaft.

6. In a microwave oven having means defining an oven cavity, a source of microwave energy, and means coupling the energy from the source to the cavity, the improvement comprising;

a beam stirrer disposed in the oven cavity in a position to receive the coupled energy and including a cylindrical body of approximately quarter wave length height, means eccentrically supporting the structure including a shaft and tab means for securing the shaft close to one section of the body and motor means coupled to the shaft for rotating the cylindrical body to thereby deflect the beam in many directions with the energy being coupled relatively uniformly as the structure rotates, wherein a small angle is provided between the center line of the shaft and the center line of the body.

7. The beam stirrer of claim 6 wherein said tab means is slightly bent to provide the slight angle.

8. The beam stirrer of claim 7 wherein the slight angle is on the order of 5°–15°.

9. In a microwave oven having a source of microwave energy, a cooking cavity and waveguide means coupling from the source to an opening into the cooking cavity, a beam stirrer disposed adjacent the opening and comprising a resonant structure that represents a relatively low impedance to the energy, is disposed adjacent the opening into the cooking cavity and covers a first area intermediate the opening and cooking cavity and means for eccentrically rotating the structure to spread the energy beam without substantially disrupting the impedance to energy and so that the structure when rotating covers a second area larger than said first area and also intermediate the opening and cooking cavity.

10. The beam stirrer of claim 9 wherein said energy coupling structure includes a solid plate.

11. A microwave oven comprising;

a source of microwave energy, a waveguide of predetermined cross-section positioned with one end receiving energy from said source for transmission through said waveguide, the frequency of operation of said source and the dimension of said waveguide being selected to excite the dominant mode in said waveguide, means defining an enclosure including means for providing access to the enclosure and means defining an opening into the enclosure, matching means coupling from the other end of the waveguide to the opening in the enclosure for establishing primarily only the dominant mode in the enclosure, and energy coupling and directing means disposed at the opening to the enclosure and including a ring structure dimensioned to act as a low impedance to the energy and covering a first area and means for rotating the ring structure to cover a second area larger than the first area.

12. In a microwave oven as set forth in claim 9 wherein the resonant structure includes a cylindrical shaped member and the means for eccentrically rotating includes a shaft, means for connecting one end of the shaft to the member and means for driving the other end of the shaft.

13. In a microwave oven as set forth in claim 12 wherein the opening is in the top of the oven into the cooking cavity and the shaft is positioned vertically.

14. In a microwave oven as set forth in claim 13 wherein the member defines an open coupling hole for passing energy from the opening into the cavity.

* * * * *